US009734766B2

(12) United States Patent
Sakaigawa et al.

(10) Patent No.: US 9,734,766 B2
(45) Date of Patent: Aug. 15, 2017

(54) LIGHTING DEVICE, LIGHTING CONTROL METHOD, AND DISPLAY DEVICE

(71) Applicant: Japan Display Inc., Tokyo (JP)

(72) Inventors: Akira Sakaigawa, Tokyo (JP); Toshiyuki Nagatsuma, Tokyo (JP)

(73) Assignee: Japan Display Inc., Tokyo (JP)

( * ) Notice: Subject to any disclaimer, the term of this patent is extended or adjusted under 35 U.S.C. 154(b) by 62 days.

(21) Appl. No.: 14/804,479

(22) Filed: Jul. 21, 2015

(65) Prior Publication Data

US 2016/0063928 A1 Mar. 3, 2016

(30) Foreign Application Priority Data

Aug. 28, 2014 (JP) ..... 2014-173470

(51) Int. Cl.
*G09G 5/00* (2006.01)
*G09G 3/34* (2006.01)

(52) U.S. Cl.
CPC ..... *G09G 3/3406* (2013.01); *G09G 2320/02* (2013.01); *G09G 2320/062* (2013.01); *G09G 2320/0653* (2013.01)

(58) Field of Classification Search
CPC ..... G09G 3/3406; G09G 2320/02; G09G 2320/0653; G09G 2320/062
See application file for complete search history.

(56) References Cited

U.S. PATENT DOCUMENTS

2005/0264702 A1* 12/2005 Yoshii ..... G09G 3/3406 348/687
2008/0231581 A1* 9/2008 Fujine ..... G09G 3/3406 345/98
2011/0181635 A1 7/2011 Kabe et al.
2013/0093803 A1 4/2013 Saitoh
2013/0187958 A1* 7/2013 Kimpe ..... G09G 3/3406 345/690
2014/0267471 A1 9/2014 Harada et al.

FOREIGN PATENT DOCUMENTS

JP 2011-154323 A 8/2011
WO WO-2012/017899 A1 2/2012

* cited by examiner

*Primary Examiner* — Adam R Giesy
(74) *Attorney, Agent, or Firm* — Michael Best & Friedrich LLP

(57) ABSTRACT

A lighting device includes a light source and a control section. The control section has a first mode and a second mode as luminance setting modes of the light source and sets, in order to exercise variable control of a reach time taken to change luminance of the light source to a determined value, the reach time on the basis of the first mode for a determined period at the time of switching from the first mode to the second mode.

11 Claims, 13 Drawing Sheets

31

| | LOW POWER MODE | OUTDOOR MODE |
|---|---|---|
| OPERATION | BACKLIGHT LUMINANCE IS REDUCED ACCORDING TO INCREASE IN BRIGHTNESS OF SCREEN CAUSED BY USING R, G, B, AND W SUBPIXELS. BACKLIGHT LUMINANCE IS CONTROLLED IN EACH IMAGE SCENE. | BACKLIGHT LUMINANCE IS FIXED AND BRIGHTNESS OF SCREEN IS INCREASED BY USING R, G, B, AND W SUBPIXELS. BACKLIGHT LUMINANCE IS CONSTANT REGARDLESS OF IMAGE SCENE. |
| BACKLIGHT POWER REDUCTION RATE | 50%(↓) | ±0% |
| MODULE LUMINANCE | 1. 0 | 2. 0 |
| SUNLIGHT VISIBILITY | LIMITED | VERY GOOD |

FIG. 2

FIG. 9

32

| DIMMING SPEED SETTING | TIME Tr90% (SECOND) |
|---|---|
| 0 | 13.056 |
| 1 | 8.704 |
| 2 | 6.528 |
| 3 | 4.352 |
| 4 | 3.264 |
| 5 | 2.176 |
| 6 | 1.632 |
| 7 | 1.088 |
| 8 | 0.816 |
| 9 | 0.544 |
| 10 | 0.408 |
| 11 | 0.272 |
| 12 | 0.136 |
| 13 | 0.068 |
| 14 | 0.034 |
| 15 | 0.017 |

LIGHTING DEVICE, LIGHTING CONTROL METHOD, AND DISPLAY DEVICE

CROSS-REFERENCE TO RELATED APPLICATION

This application is based upon and claims the benefit of priority of the prior Japanese Patent Application No. 2014-173470, filed on Aug. 28, 2014, the entire contents of which are incorporated herein by reference.

FIELD

The embodiments discussed herein are related to a lighting device, a lighting control method, and a display device.

BACKGROUND

In recent years liquid crystal panel display devices in which the RGBW system is adopted have been developed. With the RGBW system each pixel is made up of an ordinary red (R) subpixel, green (G) subpixel, and blue (B) subpixel, and a white (W) subpixel. Luminance is improved by the W subpixel, so the luminance of a lighting device, such as a backlight, which lights a liquid crystal panel from, for example, the rear can be reduced. This reduces the power consumption of an entire liquid crystal panel display device.

With the above display system, on the other hand, adjustment of the luminance of a lighting device made according to a change in displayed image may degrade display quality. Accordingly, if gradations of an image to be displayed differ between, for example, two successive frames, the following technique is proposed. A first dimming process for changing the luminance of a lighting device according to each gradation and a second dimming process for changing the level of gradation distribution setting according to each gradation are performed for a plural frame period (see, for example, Domestic Republication of PCT Publication No. 2012/017899).

SUMMARY

There are provided a lighting device, a lighting control method, and a display device which improve image quality degradation. Alternatively, there are provided a lighting device, a lighting control method, and a display device which realize highly accurate luminance control.

According to an aspect, there is provided a lighting device including a light source and a control section which has a first mode and a second mode as luminance setting modes of the light source and which sets, in order to exercise variable control of a reach time taken to change luminance of the light source to a determined value, the reach time on the basis of the first mode for a determined period at the time of switching from the first mode to the second mode.

The object and advantages of the invention will be realized and attained by means of the elements and combinations particularly pointed out in the claims.

It is to be understood that both the foregoing general description and the following detailed description are exemplary and explanatory and are not restrictive of the invention.

BRIEF DESCRIPTION OF DRAWINGS

FIG. 2 illustrates the contents of luminance setting modes;

FIG. 9 illustrates reach time in each step of a dimming process;

DESCRIPTION OF EMBODIMENT

Figure 1:
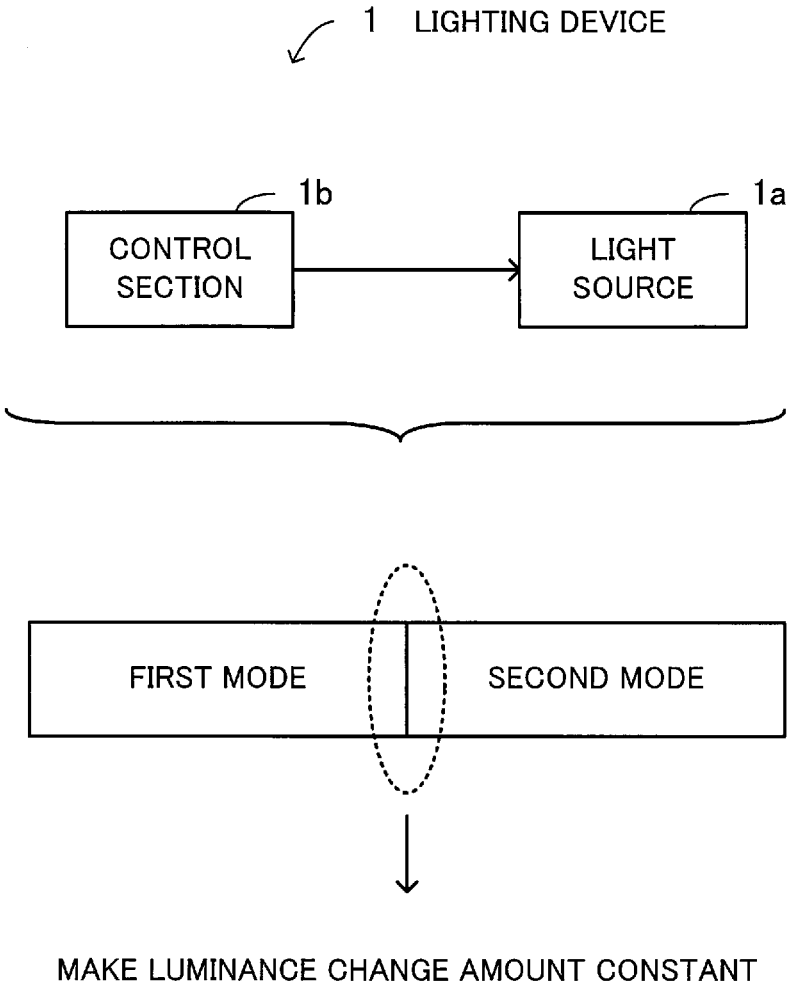
FIG. 1 illustrates an example of the structure of a lighting device.

Embodiments will now be described with reference to the accompanying drawings.

Disclosed embodiments are simple examples. It is a matter of course that a proper change which suits the spirit of the invention and which will readily occur to those skilled in the art falls within the scope of the present invention. Furthermore, in order to make description clearer, the width, thickness, shape, or the like of each component may schematically be illustrated in the drawings compared with the real state. However, it is a simple example and the interpretation of the present invention is not restricted.

In addition, in the present invention and the drawings the same components that have already been described in previous drawings are marked with the same numerals and detailed descriptions of them may be omitted according to circumstances.

FIG. 1 illustrates an example of the structure of a lighting device. A lighting device 1 includes a light source 1*a* (backlight for lighting, for example) and a control section 1*b*.

The control section 1*b* has a first mode and a second mode as luminance setting modes of the light source 1*a* and exercises variable control of reach time taken to change the luminance of the light source 1*a* to a determined value.

For example, a dimming process described later corresponds to the variable control of reach time taken to change the luminance of the light source 1*a* to a determined value.

Furthermore, for example, a mode in which the light source 1*a* is set to a first luminance and a mode in which the light source 1*a* is set to a second luminance lower than the first luminance are the first mode and the second mode respectively.

Alternatively, a mode in which the luminance of the light source 1*a* is fixed regardless of an image scene (mode in which the luminance of the light source 1*a* is not controlled) and a mode in which the luminance of the light source 1*a* set is changed in each image scene (mode in which the luminance of the light source 1*a* is controlled) may be the first mode and the second mode respectively.

If the control section 1*b* exercises the variable control, the control section 1*b* makes a luminance change amount of the light source 1*a* constant at the time of switching from the first mode to the second mode.

Highly accurate luminance control exercised by the above lighting device 1 makes a change in luminance at mode switching time constant regardless of an image scene. This makes it possible to naturally change luminance without giving a feeling of physical disorder to human eyes and to improve image quality degradation.

An embodiment will now be described in detail. First problems to be solved including, for example, an overview of the dimming process will be described by the use of FIGS. 2 through 7. In the following description it is assumed that a light source is a backlight.

With a display device in which the RGBW system is adopted, a luminance increase function by which the luminance of each of R, G, B, and W subpixels is controlled is used. This enables switching between two luminance setting modes.

One of the two luminance setting modes is a low power mode and the other is an outdoor mode.

FIG. 2 illustrates the contents of the luminance setting modes. In a table 31, a comparison is made between the low power mode and the outdoor mode regarding Operation, Backlight Power Reduction Rate, Module Luminance, and Sunlight Visibility. Switching between the low power mode and the outdoor mode is performed manually or automatically according to circumstances by instructions from an observer, the detection of the intensity of sunlight, or the like.

In the low power mode, backlight luminance is reduced according to an increase in the brightness of a screen caused by an increase in the transmittance of each pixel made up of R, G, B, and W subpixels. As a result, the original brightness of the screen is maintained and power consumption is reduced. Furthermore, in the low power mode, not only the transmittance of each pixel but also backlight luminance is controlled in each image scene.

In the low power mode, backlight luminance is reduced in the above way. As a result, the power consumption of a backlight is reduced to, for example, about 50%.

In the outdoor mode, on the other hand, backlight luminance is fixed (usually backlight luminance is fixed at a maximum value) and the transmittance of each pixel made up of R, G, B, and W subpixels is increased. By doing so, the brightness of the screen is increased. In the outdoor mode, control is exercised in this way so as to make backlight luminance fixed regardless of an image scene. Backlight luminance is fixed in the outdoor mode, so the rate of a reduction in the power consumption of the backlight is ±0%.

It is assumed that maximum display luminance is 1.0 in the low power mode. Then maximum display luminance is 2.0 in the outdoor mode. This is two times the maximum display luminance in the low power mode. In this case, display luminance means the total display luminance of a liquid crystal module including the luminance of the backlight and the transmittance of a display.

As a result, the sunlight visibility of the screen in the outdoor mode is better than that in the low power mode. Accordingly, adopting the outdoor mode improves visibility for an observer even in an environment, such as the open air, in which sunlight is strong.

The dimming process will now be described. Backlight luminance is controlled by, for example, a pulse width modulation (PWM) signal and is usually changed according to an image to be displayed.

Furthermore, when backlight luminance is controlled, usually a dimming process for gradually changing luminance is performed so that backlight luminance will not change suddenly. The dimming process means control exercised to change, at the time of changing backlight luminance from one luminance level (luminance level L1) to another luminance level (luminance level L2), reach time (or reach speed) taken for the backlight luminance to reach the luminance level L2.

Figure 3:
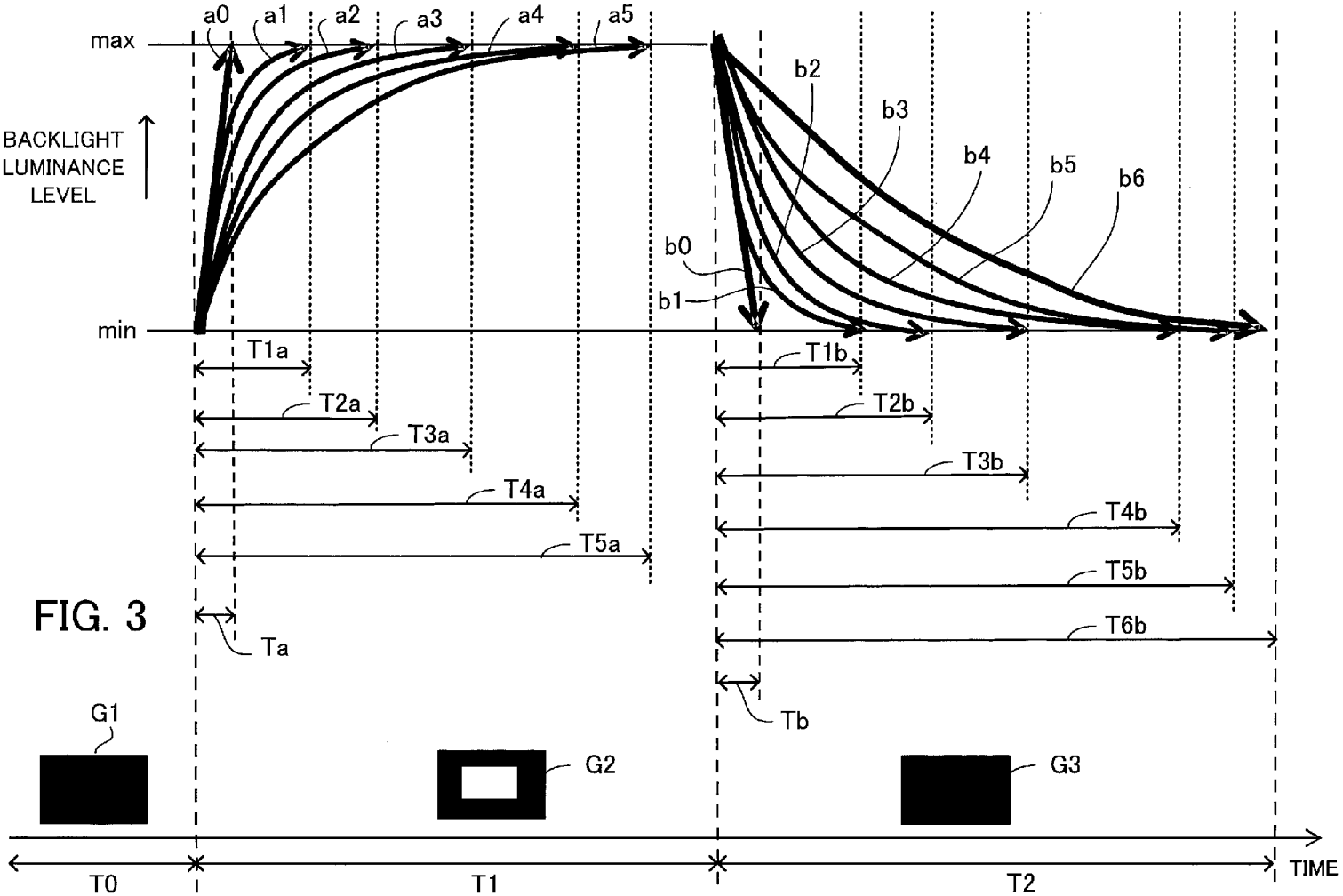
FIG. 3 is a view for giving an overview of a dimming process.

FIG. 3 is a view for giving an overview of the dimming process. In FIG. 3, a horizontal axis indicates time and a vertical axis indicates a backlight luminance level.

In the low power mode, it is assumed that an image G1 is displayed in an interval T0, that an image G2 is displayed in an interval T1, and that an image G3 is displayed in an interval T2.

It is assumed that the images G1 and G3 are substantially black images for which backlight luminance is set to a minimum value and that the image G2 is substantially a white image for which backlight luminance is set to a maximum value.

If a process a0 in which it takes a short period of time (time Ta, for example) to change backlight luminance from a minimum value min to a maximum value max is performed at the time of switching from the image G1 to the image G2, then to human eyes a screen appears to flash and instantaneously become bright.

Accordingly, when switching from the image G1 to the image G2 is performed, control is exercised by a dimming process so that it will take a determined period of time for backlight luminance to gradually change from the minimum value min to the maximum value max.

In the example of FIG. 3, with a dimming process a1 it takes time T1*a* (>time Ta) to change backlight luminance from the minimum value min to the maximum value max. With a dimming process a2 it takes time T2*a* (>time T1*a*) to change backlight luminance from the minimum value min to the maximum value max.

In addition, with a dimming process a3 it takes time T3*a* (>time T2*a*) to change backlight luminance from the minimum value min to the maximum value max. With a dimming process a4 it takes time T4*a* (>time T3*a*) to change backlight luminance from the minimum value min to the maximum value max.

Furthermore, with a dimming process a5 it takes time T5*a* (>time T4*a*) to change backlight luminance from the minimum value min to the maximum value max.

On the other hand, If a process b0 in which it takes a short period of time (time Tb, for example) to change backlight luminance from the maximum value max to the minimum value min is performed at the time of switching from the image G2 to the image G3, then to human eyes the screen appears to flash and instantaneously become dark.

Accordingly, when switching from the image G2 to the image G3 is performed, control is exercised by a dimming process so that it will take a determined period of time for backlight luminance to gradually change from the maximum value max to the minimum value min.

In the example of FIG. 3, with a dimming process b1 it takes time T1*b* (>time Tb) to change backlight luminance from the maximum value max to the minimum value min.

With a dimming process b2 it takes time T2*b* (>time T1*b*) to change backlight luminance from the maximum value max to the minimum value min.

In addition, with a dimming process b3 it takes time T3*b* (>time T2*b*) to change backlight luminance from the maximum value max to the minimum value min. With a dimming process b4 it takes time T4*b* (>time T3*b*) to change backlight luminance from the maximum value max to the minimum value min.

Furthermore, with a dimming process b5 it takes time T5*b* (>time T4*b*) to change backlight luminance from the maximum value max to the minimum value min. With a dimming process b6 it takes time T6*b* (>time T5*b*) to change backlight luminance from the maximum value max to the minimum value min.

Switching from the image G1 to the image G2 is the change from the minimum luminance level to the maximum luminance level. A fast shift from a dark screen to a bright screen is desirable to a human sense.

Accordingly, it is desirable to select as a dimming process the dimming process a1, the dimming process a2, or the like in which reach time is comparatively short (rate of an increase in backlight luminance is comparatively high).

Furthermore, switching from the image G2 to the image G3 is the change from the maximum luminance level to the minimum luminance level. A slow shift from a bright screen to a dark screen is desirable to a human sense.

Accordingly, it is desirable to select as a dimming process the dimming process b5, the dimming process b6, or the like in which reach time is comparatively long (rate of a decrease in backlight luminance is comparatively low).

As has been described, a gradual change in backlight luminance is realized by the above dimming processes. This prevents, for example, a screen from flashing.

Figure 4:
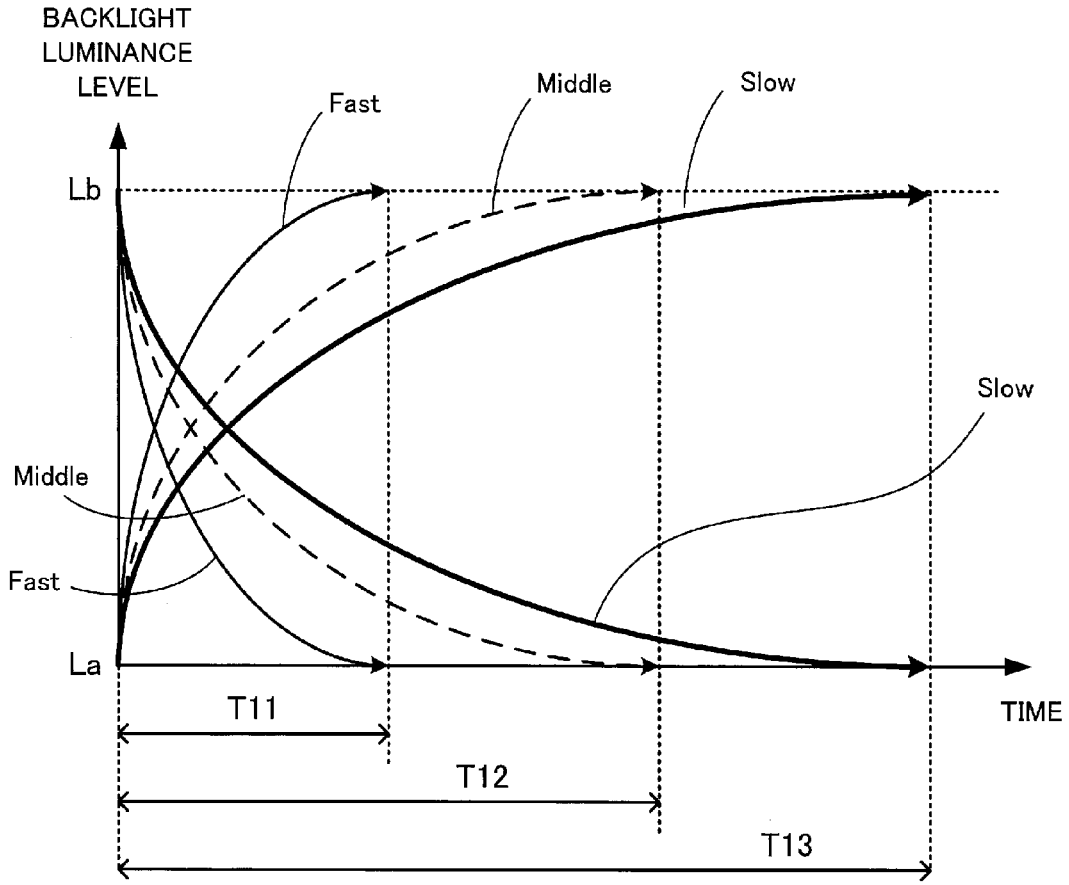
FIG. 4 illustrates setting types of the dimming process.

A case where reach time of backlight luminance is controlled by setting Slow, Middle, and Fast will now be described. FIG. 4 illustrates setting types of the dimming process. In FIG. 4, a horizontal axis indicates time and a vertical axis indicates a backlight luminance level.

Furthermore, it is assumed that three times T11, T12, and T13 are set as time taken to change backlight luminance from a luminance level La to a luminance level Lb (or time taken to change backlight luminance from the luminance level Lb to the luminance level La). In this case, time T11<time T12<time T13.

A dimming process in which it takes the shortest time T11 to change backlight luminance from the luminance level La to the luminance level Lb (or to change backlight luminance from the luminance level Lb to the luminance level La) is referred to as a dimming process of a fast setting type. In FIG. 4, a change in backlight luminance indicated by a thin solid line arrow corresponds to a dimming process of the fast setting type.

Furthermore, a dimming process in which it takes the longest time T13 to change backlight luminance from the luminance level La to the luminance level Lb (or to change backlight luminance from the luminance level Lb to the luminance level La) is referred to as a dimming process of a slow setting type. In FIG. 4, a change in backlight luminance indicated by a thick solid line arrow corresponds to a dimming process of the slow setting type.

In addition, a dimming process in which it takes the time T12, which is intermediate between the time T11 and the time T13, to change backlight luminance from the luminance level La to the luminance level Lb (or to change backlight luminance from the luminance level Lb to the luminance level La) is referred to as a dimming process of a middle setting type. In FIG. 4, a change in backlight luminance indicated by a dashed-line arrow corresponds to a dimming process of the middle setting type.

As stated above, if backlight luminance is changed from one luminance level L1 to another luminance level L2 in a dimming process, parameter setting or the like is performed. By doing so, the slow, middle, and fast setting types are set on the basis of reach time taken for backlight luminance to change from the luminance level L1 to the luminance level L2.

In the above example, with the fast setting type backlight luminance reaches a target luminance level fastest. With the middle setting type backlight luminance reaches the target luminance level next fastest to the fast setting type. Furthermore, with the slow setting type backlight luminance reaches the target luminance level most slowly.

Image frame switching is performed at 60 Hz (every 16.6 ms). On the other hand, backlight luminance is changed, for example, every several seconds in a dimming process of the slow setting type in the low power mode (it is a matter of course that not only a dimming process of the slow setting type but also a dimming process of the fast setting type or the middle setting type is performed depending on an image scene).

In the above description three types, that is to say, the slow setting type, the middle setting type, and the fast setting type are set. However, two types may be set by using two different reach times, or four or more types may be set by using more different reach times.

A dimming process at the time of switching from the low power mode to the outdoor mode will now be described. FIG. 3 illustrates a change in backlight luminance in the low power mode. However, a change in backlight luminance occurs at the time of switching from the low power mode to the outdoor mode.

Switching from the low power mode to the outdoor mode causes a change in backlight luminance. That is to say, in the low power mode, backlight luminance is low for reducing power consumption. The backlight luminance is increased to a fixed value (maximum value) in the outdoor mode.

Figure 5:
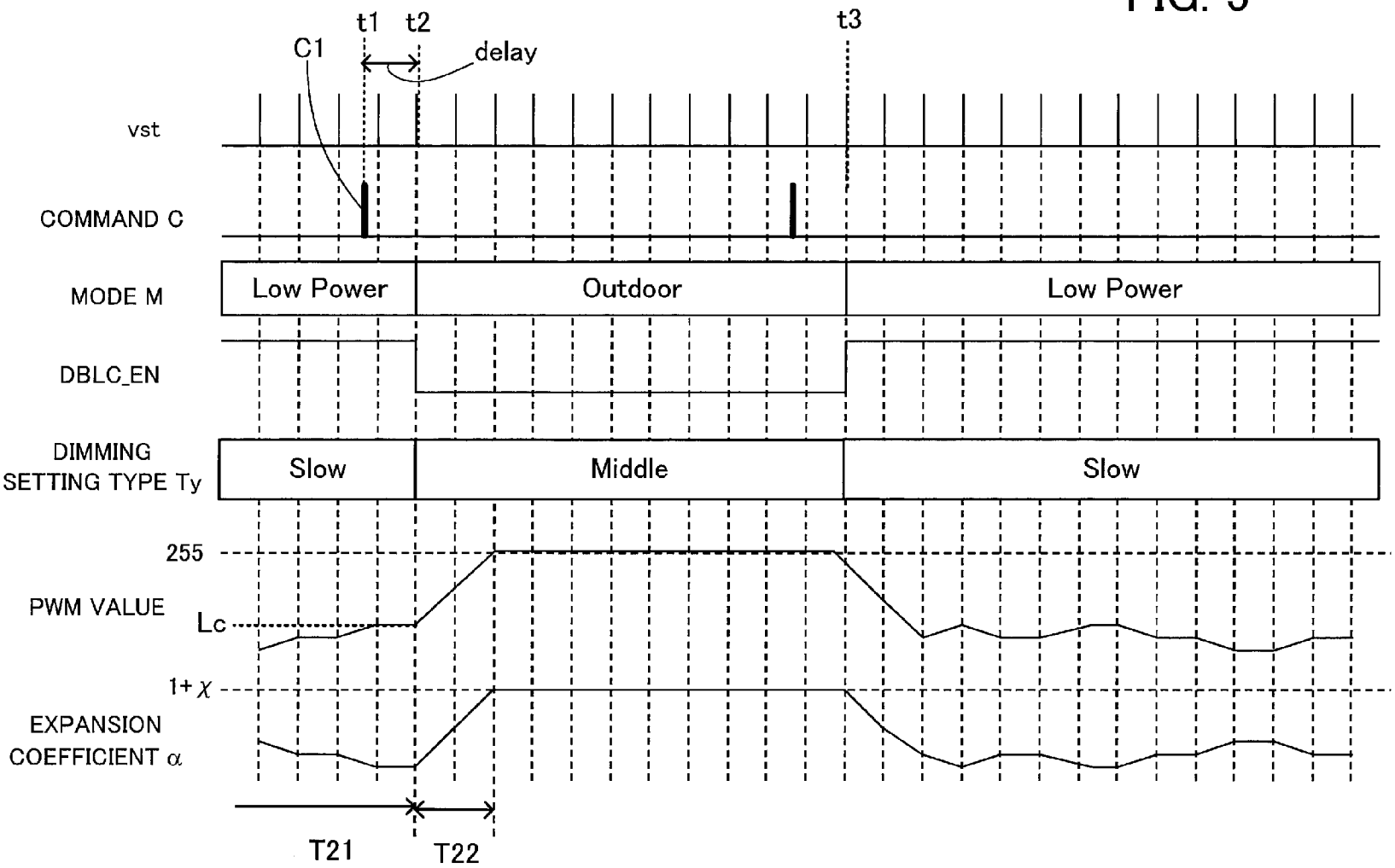
FIG. 5 is a time chart for describing a dimming process at the time of switching from a low power mode to an outdoor mode.

FIG. 5 is a time chart for describing a dimming process at the time of switching from the low power mode to the outdoor mode. vst is timing of a vertical synchronizing signal. Accordingly, the time interval between adjacent vst's corresponds to one frame time.

Command C is a signal transmitted from, for example, an upper central processing unit (CPU). Mode switching (low power mode→outdoor mode or outdoor mode→low power mode) in a dimming process is designated by Command C.

Mode M represents the low power mode or the outdoor mode as the state of a backlight luminance setting mode. DBLC_EN (Dynamic Back Light Control Enable) represents a backlight luminance setting mode by a signal level. In the low power mode, DBLC_EN is at an H level. In the outdoor mode, DBLC_EN is at an L level.

Dimming Setting Type Ty represents as a setting type of a dimming process the slow setting, the middle setting, or the fast setting in the low power mode or the outdoor mode.

PWM Value is the value of a signal by which a backlight luminance level is really adjusted. Expansion Coefficient $\alpha$ changes the transmittance of a display and is the reciprocal of a PWM value. Furthermore, $\chi$ in FIG. 5 represents the ratio of the luminance of a W subpixel to the luminance of an R subpixel, a G subpixel and a B subpixel. That is to say, $\chi$=(luminance of W subpixel)/{(luminance of R subpixel)+(luminance of G subpixel)+(luminance of B subpixel)}.

The above Dimming Setting Type Ty indicates which of the slow setting type, the middle setting type, and the fast setting type is set in the low power mode or the outdoor mode. Accordingly, switching from the slow setting to the middle setting at time t2 in FIG. 5, for example, does not mean that complete switching from the slow setting to the middle setting is performed, but means that the middle setting type is set as a setting type in the outdoor mode to which switching from the low power mode is performed at the time t2.

Similarly, switching from the middle setting to the slow setting at time t3 does not mean that Dimming Setting Type Ty is completely switched from the middle setting to the slow setting, but means that the slow setting type is set as a setting type in the low power mode to which switching from the outdoor mode is performed at the time t3.

(Time t1) A command C1 which designates switching of a backlight luminance setting mode (low power mode→outdoor mode) is transmitted from an upper component.

(Time t2) Mode M is switched from the low power mode to the outdoor mode. Actually, a delay occurs due to processing by a circuit after the receiving of the command C1 before the beginning of mode switching. Accordingly, FIG. 5 also illustrates delay time of the delay.

DBLC_EN changes from the H level to the L level at the time of switching from the low power mode to the outdoor mode at the time t2. Furthermore, it is assumed that Dimming Setting Type Ty changes from the slow setting in the low power mode to the middle setting in the outdoor mode at the time of switching from the low power mode to the outdoor mode at the time t2.

(Interval T21) Dimming Setting Type Ty is the slow setting, so the speed of a change in backlight luminance is comparatively slow. Accordingly, a change in PWM value for controlling backlight luminance every frame is gradual.

(Interval T22) Switching from the low power mode to the outdoor mode is performed, so it takes comparatively short time (two frame time in the example of FIG. 5) for a PWM value to increase from a level Lc to the level 255. Backlight luminance is fixed in the outdoor mode and at this time a PWM value is the maximum value, that is to say, 255. This leads to a state in which the maximum electric power is supplied to the backlight (state in which backlight luminance is highest).

As has been described, a dimming process is also performed on a change in backlight luminance at the time of switching from the low power mode to the outdoor mode. In addition, if switching from the low power mode to the outdoor mode is performed, a user performs switching to the outdoor mode to improve outdoor visibility. Accordingly, usually the user expects backlight luminance to increase in a comparatively short period of time rather than slowly, that is to say, expects a screen to become brighter in a comparatively short period of time rather than slowly. However, if backlight luminance instantaneously reaches the maximum value, then the screen appears to flash. This gives a feeling of physical disorder to the user's eyes.

Accordingly, as stated above, control is exercised at the time of switching from the low power mode to the outdoor mode so that backlight luminance will gradually change by adopting the middle setting as a dimming setting type set in advance in the outdoor mode.

By exercising the above control, backlight luminance increases at a relatively high speed at the time of switching from the low power mode to the outdoor mode. Furthermore, backlight luminance is fixed in the outdoor mode and always changes in accordance with the middle setting. Accordingly, to human eyes it does not appear at the time of switching from the low power mode to the outdoor mode to be specially unnatural.

A dimming process at the time of switching from the outdoor mode to the low power mode will now be described. A change in backlight luminance also occurs at the time of switching from the outdoor mode to the low power mode. Switching from the outdoor mode to the low power mode causes a change in backlight luminance. That is to say, backlight luminance is decreased from the maximum value currently set in the outdoor mode to reduce power consumption in the low power mode.

A dimming process is also performed for such a change in backlight luminance.

Figure 6:
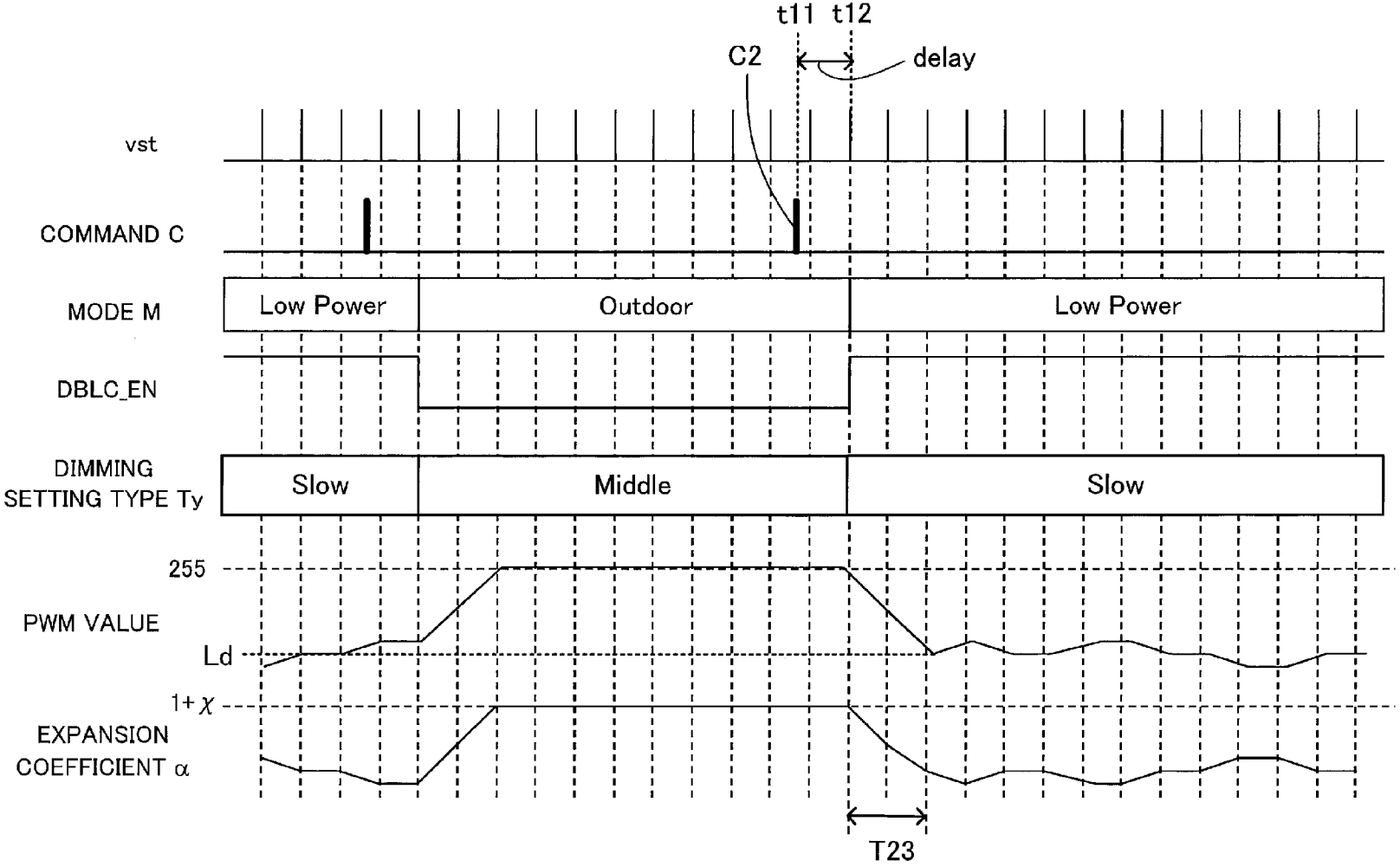
FIG. 6 is a time chart for describing a dimming process at the time of switching from the outdoor mode to the low power mode.

FIG. 6 is a time chart for describing a dimming process at the time of switching from the outdoor mode to the low power mode. In FIG. 6, Dimming Setting Type Ty is slow setting in the low power mode from time t12 on. The contents of parameter items stated on the left side of the time chart of FIG. 6 have been described above, so their descriptions will be omitted.

(Time t11) Command C2 which designates switching of a backlight luminance setting mode (outdoor mode→low power mode) is transmitted from an upper component.

(Time t12) Mode M is switched from the outdoor mode to the low power mode. DBLC_EN changes from the L level to the H level at the time of switching from the outdoor mode to the low power mode at the time t12.

Furthermore, it is assumed that Dimming Setting Type Ty changes from the middle setting in the outdoor mode to the slow setting in the low power mode at the time of switching from the outdoor mode to the low power mode at the time t12.

(Interval T23) When switching from the outdoor mode to the low power mode is performed, a dimming setting type in the low power mode changes according to an image scene, user setting, or the like. In the case of FIG. 6, a dimming setting type is the slow setting and it takes a determined period of time for a PWM value to decrease from 255 (maximum level) to a level Ld.

Figure 7:
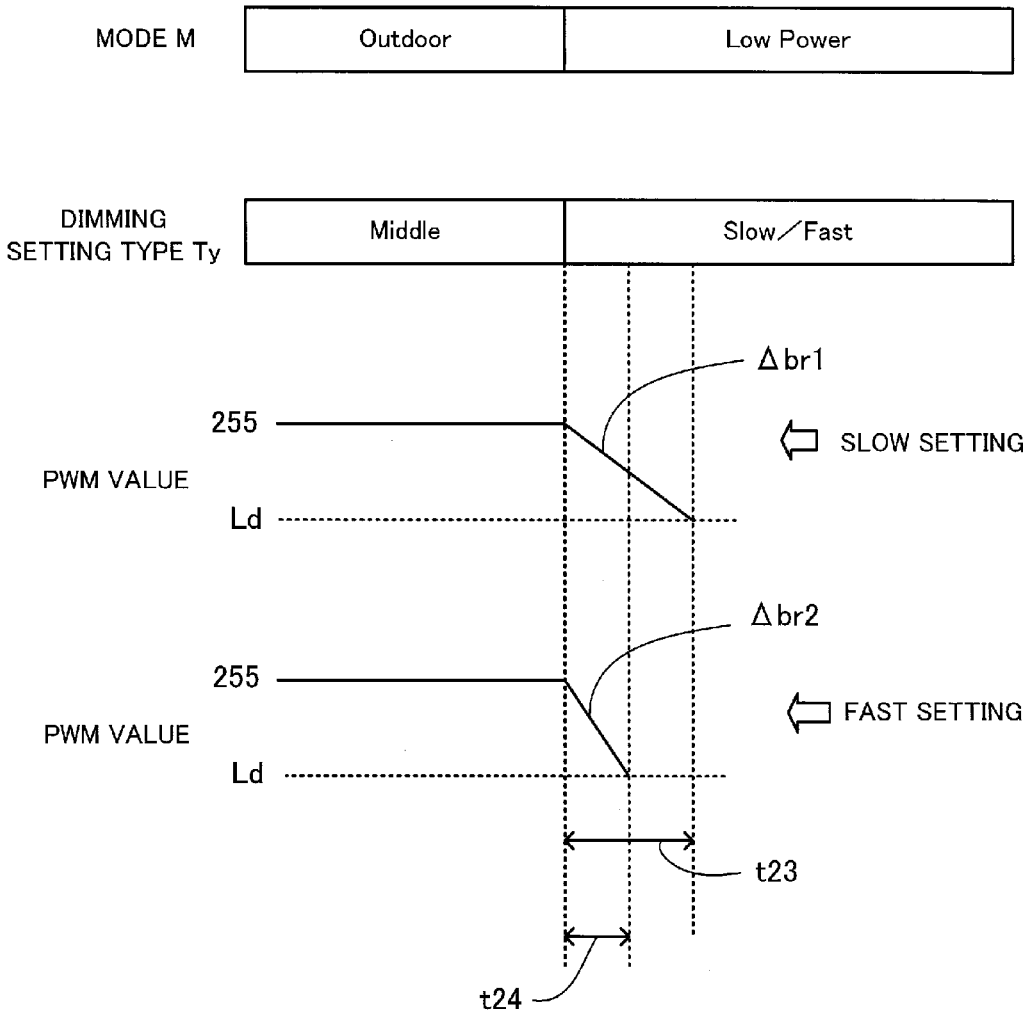
FIG. 7 illustrates a difference in luminance change amount at the time of switching from the outdoor mode to the low power mode.

FIG. 7 illustrates a difference in luminance change amount at the time of switching from the outdoor mode to the low power mode. In FIG. 6, Dimming Setting Type Ty is the slow setting in the low power mode after switching from the outdoor mode to the low power mode. In this case, it is assumed that it takes reach time t23 for a PWM value to decrease from 255 (maximum level) to the level Ld and that at this time a luminance change amount is Δbr1.

On the other hand, if a dimming setting type is the fast setting in the low power mode after switching from the outdoor mode to the low power mode, then reach time taken for a PWM value to decrease from 255 (maximum level) to the level Ld is shorter than the reach time taken in the case of the slow setting.

It is assumed that the reach time taken in the case of the fast setting is t24 and that a luminance change amount is Δbr2. In this case, reach time t24<reach time t23 and luminance change amount Δbr1<luminance change amount Δbr2.

As stated above, a luminance change amount (or reach time) taken for backlight luminance to reach a determined target value differs at the time of switching from the outdoor mode to the low power mode between a case where a dimming setting type is the slow setting in the low power mode and a case where a dimming setting type is the fast setting in the low power mode.

As has been described, a dimming setting type in the low power mode after switching from the outdoor mode to the low power mode is not always the same in a dimming process for a change in backlight luminance at the time of switching from the outdoor mode to the low power mode. That is to say, the fast setting or the slow setting may be adopted according to an image scene, user setting, or the like in a dimming process in the low power mode.

Accordingly, if switching from the outdoor mode in which backlight luminance is at the maximum value to the low power mode in which backlight luminance depends on an image scene is performed, a change in backlight luminance may be rapid (in the case of the fast setting) or slow (in the case of the slow setting), depending on an image scene. To human eyes it appears to be unnatural.

The present disclosure is made in view of this problem. A dimming process in which a luminance change amount at mode switching time is set to a determined value is performed to improve image quality degradation.

The lighting device 1 according to an embodiment will now be described in detail. If the control section 1*b* of the lighting device 1 performs switching from the outdoor mode to the low power mode, then the control section 1*b* makes a luminance change amount in a dimming process equal to a luminance change amount set at the time of switching from the low power mode to the outdoor mode for determined time from the timing of instructions to perform switching from the outdoor mode to the low power mode.

In other words, if switching from the outdoor mode to the low power mode is performed, instantaneous switching to a dimming setting type set in the low power mode is not performed. A dimming setting type in the outdoor mode is kept for determined time instead.

For example, if a dimming setting type set in advance in the outdoor mode is the middle setting, then the middle setting is kept for the determined time from the timing of instructions to perform switching from the outdoor mode to the low power mode. After the elapse of the determined time, a shift to a dimming setting type in the low power mode which depends on an image scene is performed.

For example, an internal timer is used for counting the above determined time from the timing of instructions to perform switching from the outdoor mode to the low power mode. After the elapse of the determined time, a dimming setting type in the low power mode is changed according to an image scene.

Figure 8:
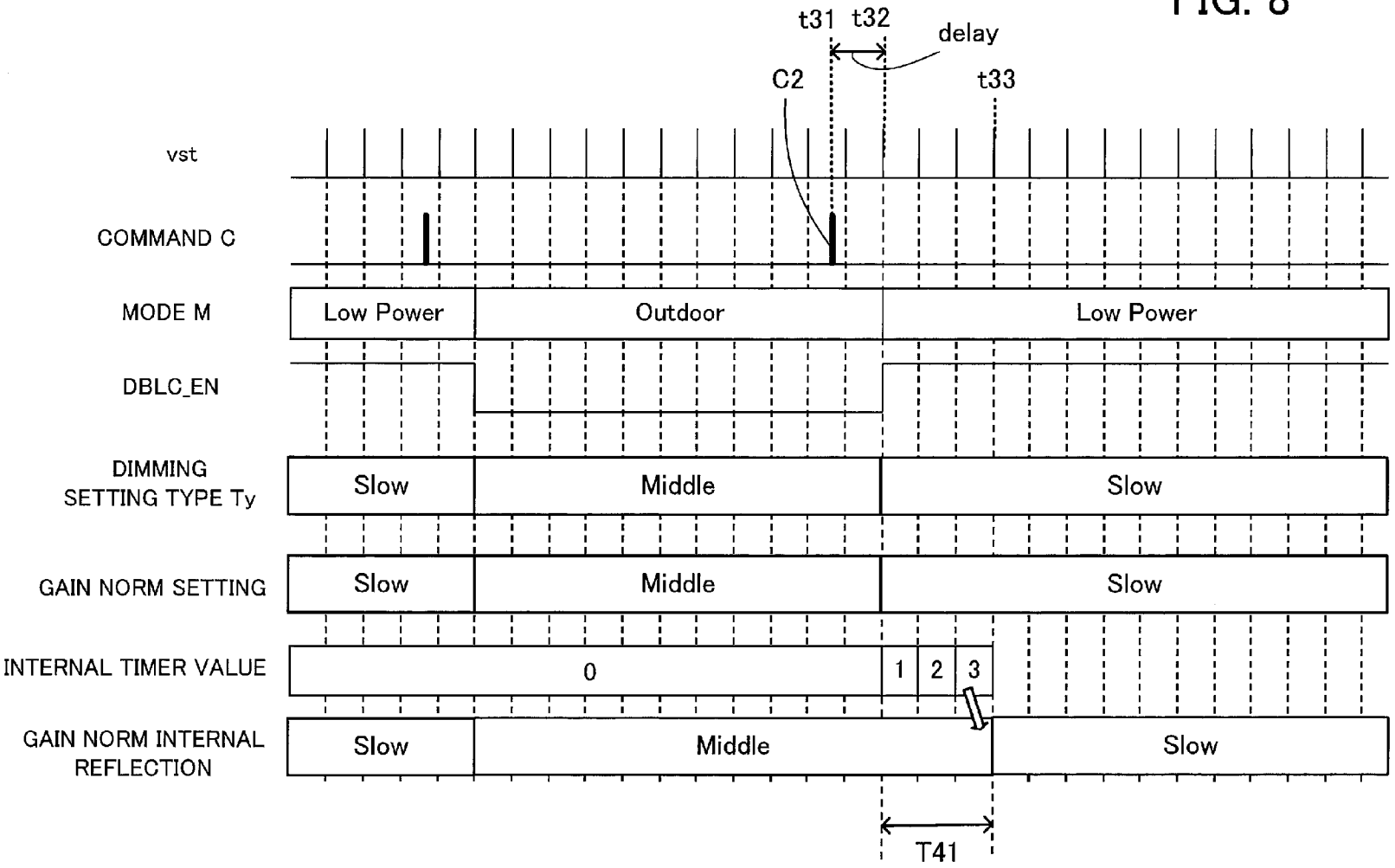
FIG. 8 is a view for describing the operation of making a luminance change amount constant at mode switching time.

A concrete example of operation at the time of switching from the outdoor mode to the low power mode will now be described. FIG. 8 is a view for describing the operation of making a luminance change amount constant at mode switching time. The operation of the control section 1*b* is performed by a gain norm (normal) setting section.

The gain norm setting section has the function of the control section 1*b* and controls the whole dimming process. In addition, for example, when the gain norm setting section receives a command which gives instructions to perform switching of a backlight luminance setting mode, the gain norm setting section starts an internal timer.

In FIG. 8, Gain Norm Setting indicates a dimming setting type which the gain norm setting section recognizes. Furthermore, Internal Timer Value indicates count time counted by the internal timer. In addition, Gain Norm Internal Reflection indicates a dimming setting type actually set for the backlight.

(Time t31) A command C2 which designates switching of a backlight luminance setting mode (outdoor mode→low power mode) is transmitted from an upper component.

(Time t32) Mode M is switched from the outdoor mode to the low power mode. DBLC_EN changes from the L level to the H level at the time of switching from the outdoor mode to the low power mode at time t32.

Furthermore, it is assumed that Dimming Setting Type Ty changes from the middle setting in the outdoor mode to the slow setting in the low power mode at the time of switching from the outdoor mode to the low power mode at the time t32.

On the other hand, when the gain norm setting section recognizes at the time t32 that the gain norm setting section receives the command C2, the gain norm setting section starts the internal timer. The internal timer counts time set in advance.

(Interval T41) The gain norm setting section performs a dimming process in accordance with the middle setting which is the same in the outdoor mode for time from the start to the end of counting by the internal timer.

(Time t33) After the end of counting by the internal timer, the gain norm setting section makes a backlight luminance setting mode reflect the command C2 transmitted from the upper component and shifts to a dimming setting type in the low power mode (in the case of FIG. 8, the slow setting is adopted in the low power mode). Practical mode switching based on the command C2 is performed in this way after the end of counting by the internal timer.

If mode switching is performed during the measurement of determined time by the internal timer, then the operation of the measurement of the determined time is reset. As a result, even if mode switching is performed during the measurement of the determined time, the occurrence of a malfunction is prevented.

Furthermore, in the above case, the slow setting is adopted in the low power mode. However, even if the fast setting is adopted in the low power mode, the gain norm setting section performs a dimming process in accordance with the middle setting which is the same in the outdoor mode for time from the start to the end of counting by the internal timer. After the end of counting by the internal timer, the gain norm setting section makes a backlight luminance setting mode reflect the command C2 transmitted from the upper component and shifts to the fast setting as a dimming setting type in the low power mode.

In the above description the gain norm setting section performs a dimming process in accordance with the middle setting which is the same in the outdoor mode for time from the start to the end of counting by the internal timer. However, this is an example and there is no limit. The gain norm setting section may perform a dimming process in accordance with another setting for the time from the start to the end of counting by the internal timer as long as this setting is the same in the outdoor mode.

FIG. 9 illustrates reach time in each step of a dimming process. A table 32 includes Dimming Speed Setting and Time items.

Dimming Speed Setting indicates an identification number for identifying a set value from among plural set reach time values taken to perform switching from luminance L1 to luminance L2. In the example of FIG. 9, 16 set reach time values are indicated.

Time indicates reach time (second) of a change in luminance corresponding to a number indicated by Dimming Speed Setting. A numeric value indicated by Time is a value at Tr (time rise) 90%. "Tr 90%" means that when luminance rises from the luminance L1 to the luminance L2, the luminance is considered to have risen at 90% of the luminance L2. Accordingly, when the luminance reaches 90% of the luminance L2, switching from the luminance L1 to the luminance L2 is considered to have been complete.

Figure 10:
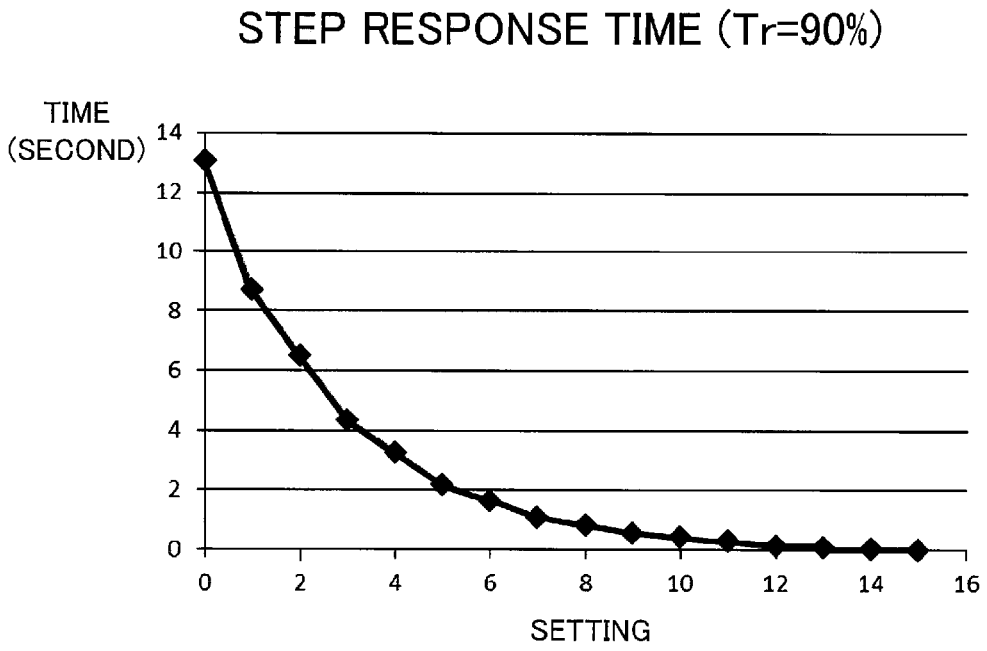
FIG. 10 is a graph indicative of the correspondence between dimming speed setting and reach time.

FIG. 10 is a graph indicative of the correspondence between dimming speed setting and reach time. In FIG. 10, a horizontal axis indicates a value of Dimming Speed Setting in FIG. 9 and a vertical axis indicates a value of Time (value of "Tr 90%") in FIG. 9.

An example of a dimming process at the time of switching from the outdoor mode to the low power mode will now be described by the use of the table 32. In the table of FIG. 9, for example, it is assumed that Dimming Speed Setting=0 to 4 corresponds to the slow setting, that Dimming Speed Setting=5 to 10 corresponds to the middle setting, and that Dimming Speed Setting=11 to 15 corresponds to the fast setting.

It is assumed that a dimming setting type in the outdoor mode is the middle setting corresponding to Dimming Speed Setting=10 and that a dimming setting type in the low power mode is the slow setting corresponding to Dimming Speed Setting=3.

When the gain norm setting section recognizes that the gain norm setting section receives a command which designates switching from the outdoor mode to the low power mode, the gain norm setting section starts the internal timer. In this case, it is assumed that the middle setting is used in the outdoor mode at the time of switching from the outdoor mode to the low power mode. Then the gain norm setting section makes the internal timer count Time=0.408 (second) corresponding to Dimming Speed Setting=10. In the example of FIG. 8, interval T41=0.408 (second).

The gain norm setting section changes luminance in accordance with the middle setting for 0.408 second from the time when the gain norm setting section receives the command which designates switching from the outdoor mode to the low power mode. After that the gain norm setting section performs a dimming process in the low power mode in accordance with the slow setting corresponding to Dimming Speed Setting=3.

As has been described in the foregoing, if a first luminance change amount (luminance change amount corresponding to the middle setting, for example) by which first reach time (reach time taken for the middle setting, for example) is taken to change luminance to a determined value is set in a first mode (outdoor mode, for example), then determined time is measured at the time of switching from the first mode to a second mode (low power mode, for example).

By setting the first luminance change amount set in the first mode for the determined time, a luminance change amount at the time of mode switching is made constant. A determined luminance change amount may be set in place of the first luminance change amount. By using the first luminance change amount or a value substantially equal to the first luminance change amount, however, a feeling of physical disorder at the time of seeing with eyes is relieved further.

That is to say, determined time is measured from the time when a command which designates mode switching is received at the time of switching from the outdoor mode to the low power mode. The middle setting set in the outdoor mode is used for the determined time. This makes a luminance change amount constant (this luminance change amount is the same as a luminance change amount (middle setting) at the time of switching from the low power mode to the outdoor mode).

As a result, a change in luminance at the time of switching from the outdoor mode to the low power mode is made constant regardless of the type of a screen. Accordingly, a change in luminance is made natural and image quality is improved.

In the above description, the first mode is the outdoor mode and the second mode is the low power mode. Furthermore, the receiving of a command which designates switching between these modes is recognized and control is exercised so as to make a luminance change amount at the time of the mode switching constant.

On the other hand, a change in dimming setting type may be monitored. For example, if a change in dimming setting type is recognized, then control is exercised so as to make a luminance change amount at the time of the change in dimming setting type constant.

Another embodiment (modification) will now be described. In FIG. 8, determined time is measured from the time when a command which designates mode switching is received at the time of switching from the outdoor mode to the low power mode. The middle setting used in the outdoor mode is used for the determined time. This makes a luminance change amount at the time of the mode switching constant.

In a modification, on the other hand, it is assumed that plural luminance change amounts are set in advance on a step-by-step basis in the low power mode. In this case, when the receiving of a command is recognized, a luminance level is changed in an interval (interval T41 in FIG. 8, for example) from a luminance level currently set in the outdoor mode, for example, by an N-stage process. After that a shift to the slow setting or the fast setting in the low power mode is performed.

This control also makes a luminance change amount constant at the time of switching from the outdoor mode to the low power mode.

Figure 11:
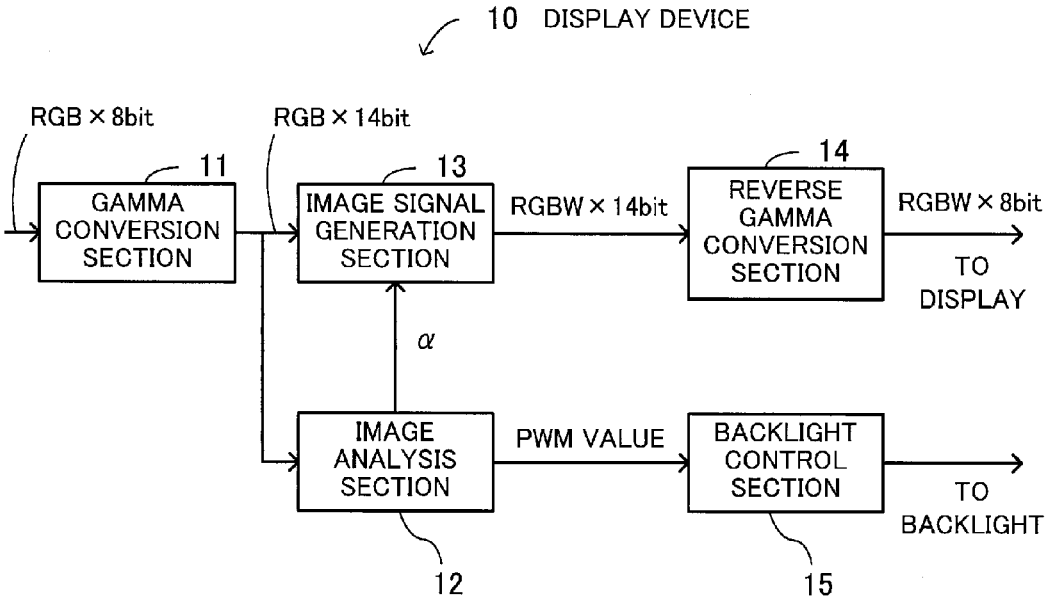
FIG. 11 illustrates an example of the structure of a display device.

A display device including the function of a lighting device according to an embodiment will now be described. FIG. 11 illustrates an example of the structure of a display device. A display device 10 includes a gamma (γ) conversion section 11, an image analysis section 12, an image signal generation section 13, a reverse gamma (1/γ) conversion section 14, and a backlight control section 15 as a display control system. The image analysis section 12 includes the function of the control section 1*b* illustrated in FIG. 1.

The gamma conversion section 11 gamma-converts an input RGB signal (first image) including an 8-bit R (first subpixel) signal value, an 8-bit G (second subpixel) signal value, and an 8-bit B (third subpixel) signal value, and outputs an RGB signal including, for example, a 14-bit R signal value, a 14-bit G signal value, and a 14-bit B signal value.

When the image analysis section 12 receives the RGB signal outputted from the gamma conversion section 11, the image analysis section 12 calculates an expansion coefficient α and generates a PWM value (luminance control signal) for controlling backlight luminance. If at this time the image analysis section 12 performs a dimming process for changing backlight luminance, then the image analysis section 12 performs a determined process (filtering process (low-pass filtering), for example) on the expansion coefficient α and the PWM value and outputs them.

The image signal generation section 13 generates a W (fourth subpixel) signal value on the basis of the expansion coefficient α after the filtering process and outputs an RGBW signal (second image) including, for example, a 14-bit R signal value, a 14-bit G signal value, a 14-bit B signal value, and a 14-bit W signal value.

When the image analysis section 12 performs a dimming process, the image analysis section 12 performs a filtering process on the PWM value or the expansion coefficient α, which is the reciprocal of the PWM value. By doing so, the image analysis section 12 decreases the current frequency of the PWM value or the expansion coefficient α to a determined frequency and controls backlight luminance on the basis of the PWM value after the filtering process. Furthermore, the image signal generation section 13 generates a W signal value on the basis of the expansion coefficient α after the filtering process.

The reverse gamma conversion section 14 performs reverse gamma conversion on the RGBW signal outputted from the image signal generation section 13 to output an RGBW signal including an 8-bit R signal value, an 8-bit G signal value, an 8-bit B signal value, and an 8-bit W signal value to a display side.

The backlight control section 15 controls backlight luminance on the basis of the PWM value after the filtering process outputted from the image analysis section 12.

Figure 12:
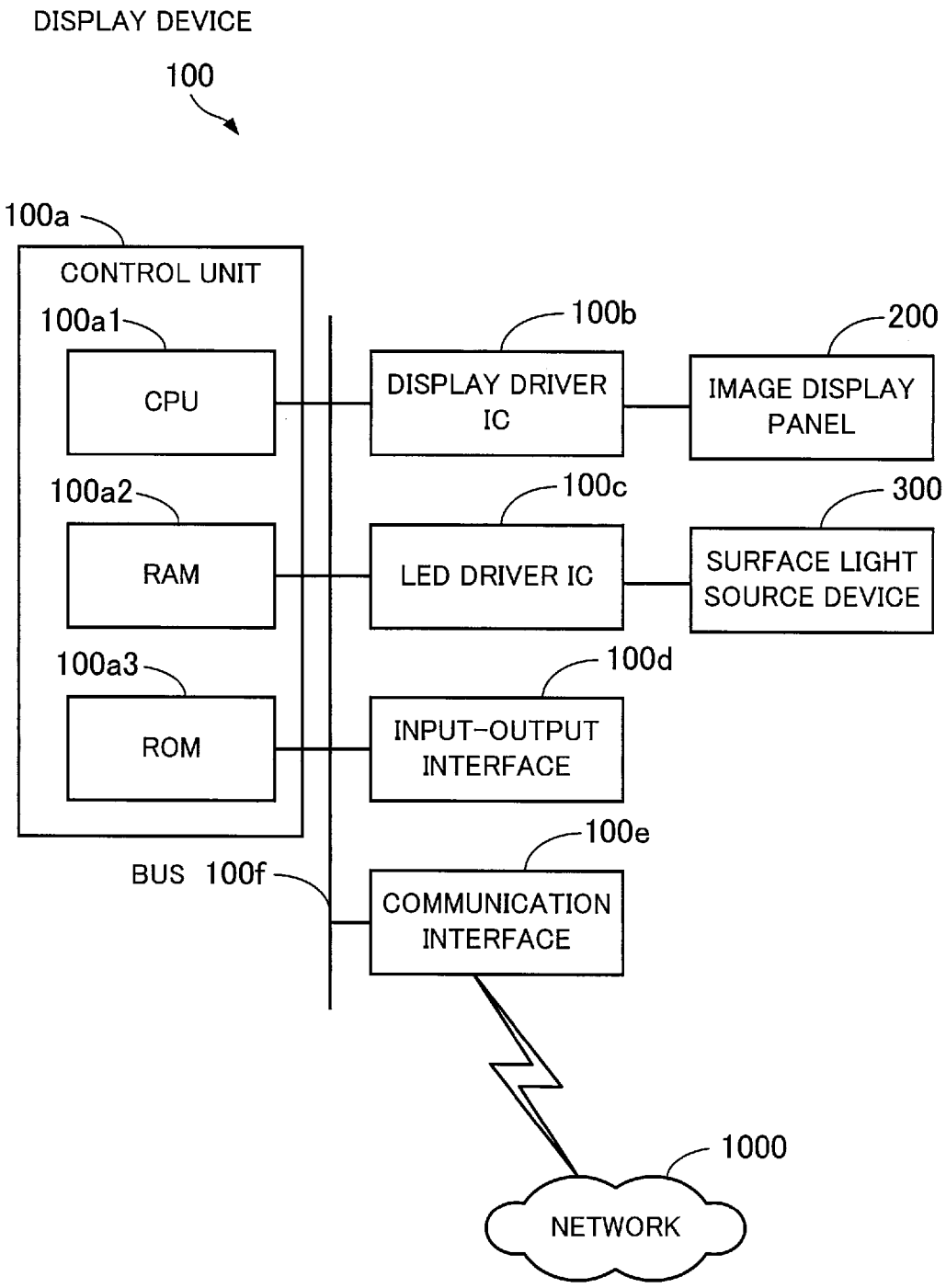
FIG. 12 illustrates an example of the hardware configuration of a display device.

An example of the hardware configuration of a display device will now be described. FIG. 12 illustrates an example of the hardware configuration of a display device. A display device 100 includes a control unit 100*a*, a display driver integrated circuit (IC) 100*b*, a light emitting diode (LED) driver IC 100*c*, an input-output interface 100*d*, and a communication interface 100*e* which are connected to one another via a bus 100*f* so as to input or output a signal. Furthermore, the display device 100 includes an image display panel 200 and a surface light source device 300.

The control unit 100*a* includes a central processing unit (CPU) 100*a*1 and the whole of the control unit 100*a* is controlled by the CPU 100*a*1. Furthermore, the control unit 100*a* includes a random access memory (RAM) 100*a*2 and a read-only memory (ROM) 100*a*3 and a plurality of peripheral units are connected to the control unit 100*a*.

The RAM 100*a*2 is used as main storage of the display device 100. The RAM 100*a*2 temporarily stores at least a part of an operating system (OS) program or an application program executed by the CPU 100*a*1. In addition, the RAM 100*a*2 stores various pieces of data which the CPU 100*a*1 needs to perform a process.

The ROM 100*a*3 is a read-only semiconductor memory and stores an OS program, an application program, and fixed data which is not rewritten. Furthermore, a semiconductor memory, such as a flash memory, may be used as auxiliary storage in place of the ROM 100*a*3 or in addition to the ROM 100*a*3.

For example, the display driver IC 100*b*, the LED driver IC 100*c*, the input-output interface 100*d*, and the communication interface 100*e* are connected to the above control unit 100*a* as peripheral units.

The image display panel 200 is connected to the display driver IC 100*b*. When an input signal is inputted to the display driver IC 100*b*, the display driver IC 100*b* performs a determined process to generate an output signal. The display driver IC 100*b* outputs a control signal corresponding to the generated output signal to the image display panel 200. By doing so, the display driver IC 100*b* makes the image display panel 200 display an image.

The LED driver IC 100*c* drives a light source according to a light source control signal and controls the luminance of the surface light source device 300.

An input device used for inputting a user's instructions is connected to the input-output interface 100*d*. An input device, such as a keyboard, a mouse used as a pointing device, or a touch panel, is connected. The input-output interface 100*d* transmits to the CPU 100*a*1 via the bus 100*f* a signal transmitted from the input device.

The communication interface 100*e* is connected to a network 1000. The communication interface 100*e* transmits data to or receives data from another computer or a communication apparatus via the network 1000.

By adopting the above hardware configuration, for example, the display device 100 realizes the processing functions in this embodiment.

Figure 13:
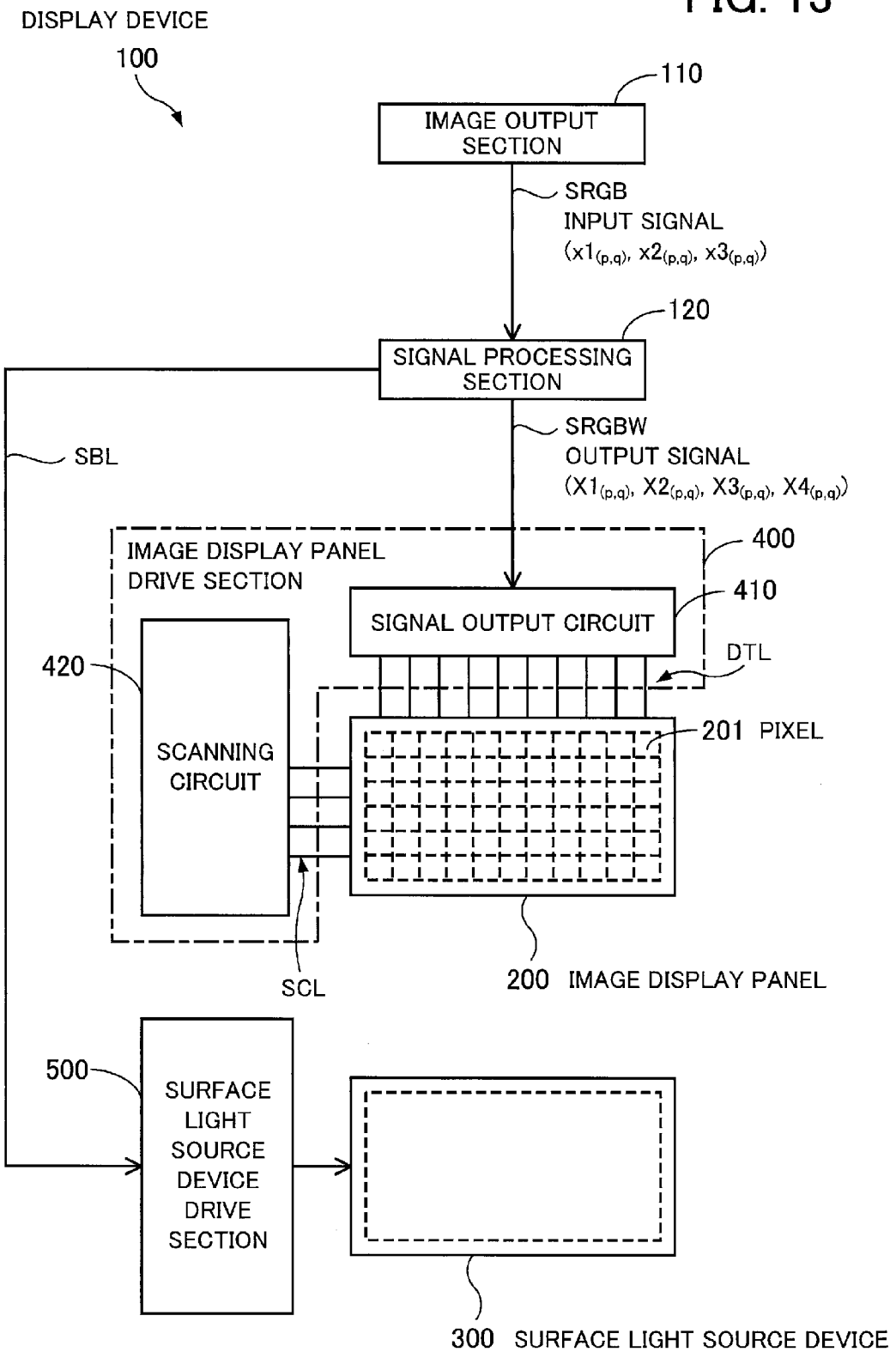
FIG. 13 illustrates an example of the structure of functions the display device has.

An example of the structure of functions the display device has will now be described. FIG. 13 illustrates an example of the structure of functions the display device has. The display device 100 includes an image output section 110 and a signal processing section 120. An output signal SRGBW is inputted to an image display panel drive section 400 and a light source control signal SBL is inputted to a surface light source device drive section 500.

The image output section 110 outputs an input signal SRGB (display gradation bit number is, for example, 8) to the signal processing section 120. The input signal SRGB includes an input signal value $x1_{(p,\ q)}$ for a first primary color, an input signal value $x2_{(p,\ q)}$ for a second primary color, and an input signal value $x3_{(p,\ q)}$ for a third primary color. It is assumed that the first primary color, the second primary color, and the third primary color are red, green, and blue respectively.

The signal processing section 120 supplies signals to the image display panel drive section 400 which drives the image display panel 200 and the surface light source device drive section 500 which drives the surface light source device 300. The signal processing section 120 determines according to the input signal SRGB an index for adjusting the luminance of each pixel of the image display panel 200 (or an index (expansion coefficient α) for reducing the luminance of the surface light source device 300), calculates according to the index luminance information for the surface light source device 300 according to pixels, makes an output signal SRGBW (display gradation bit number is, for example, 8) reflect the luminance information, and controls image display by the image display panel 200. The output signal SRGBW includes an output signal value $X4_{(p,\ q)}$ for a fourth subpixel (W) which displays a fourth color, in addition to an output signal value $X1_{(p,\ q)}$ for a first subpixel (R), an output signal value $X2_{(p,\ q)}$ for a second subpixel (G), and an output signal value $X3_{(p,\ q)}$ for a third subpixel (B). It is assumed that the fourth color is white.

The above processing operation of the signal processing section 120 is realized by the display driver IC 100*b*, the control unit 100*a*, or the like illustrated in FIG. 12.

If the above processing operation of the signal processing section 120 is realized by the display driver IC 100*b*, an input signal SRGB is inputted from the control unit 100*a* to the display driver IC 100*b*. The display driver IC 100*b* generates an output signal SRGBW and controls the image display panel 200. Furthermore, the display driver IC 100*b* generates a light source control signal SBL and transmits it to the LED driver IC 100*c* via the bus 100*f*.

If the above processing operation of the signal processing section 120 is realized by the control unit 100*a*, the control unit 100*a* inputs an output signal SRGBW to the display driver IC 100*b*. Furthermore, the CPU 100*a*1 generates a light source control signal SBL and transmits it to the LED driver IC 100*c* via the bus 100*f*.

If the above processing functions are realized with a computer, a program in which the contents of the functions that the display device has are described is provided. By executing this program on the computer, the above processing functions are realized on the computer. This program may be recorded on a computer readable record medium.

A computer readable record medium may be a magnetic storage device, an optical disk, a magneto-optical recording medium, a semiconductor memory, or the like. A magnetic storage device may be a hard disk drive (HDD), a flexible disk (FD), a magnetic tape, or the like. An optical disk may be a digital versatile disc (DVD), a DVD-RAM, a compact disc-ROM (CD-ROM), a CD-recordable(R)/rewritable (RW), or the like. A magneto-optical recording medium may be a magneto-optical disk (MO) or the like.

To place the program on the market, portable record media, such as DVDs or CD-ROMs, on which it is recorded are sold. Alternatively, the program is stored in advance in a storage unit of a server computer and is transferred from the server computer to another computer via a network.

When a computer executes this program, it will store the program, which is recorded on a portable record medium or which is transferred from the server computer, in, for example, its storage unit.

The computer then reads the program from its storage unit and performs processes in compliance with the program. The computer may read the program directly from a portable record medium and perform processes in compliance with the program. Furthermore, each time the program is transferred from the server computer connected via a network, the computer may perform processes in order in compliance with the program it receives.

In addition, at least a part of the above processing functions may be realized by an electronic circuit such as a digital signal processor (DSP), an application specific integrated circuit (ASIC), or a programmable logic device (PLD).

Various changes and modifications which fall within the scope of the concept of the present invention are conceivable by those skilled in the art and it is understood that these changes and modifications fall within the scope of the present disclosure. For example, those skilled in the art may add components to, delete components from, or make changes in the design of components in each of the above embodiments according to circumstances, or may add processes to, omit processes from, or make changes in conditions in processes in each of the above embodiments according to circumstances. These additions, deletions, changes, and omissions fall within the scope of the present disclosure if they include the essentials of the present disclosure.

The present disclosure includes the following aspects.

(1) A lighting device including: a light source; and a control section which has a first mode and a second mode as luminance setting modes of the light source and which sets, in order to exercise variable control of a reach time taken to change luminance of the light source to a determined value, the reach time on the basis of the first mode for a determined period at the time of switching from the first mode to the second mode.

(2) The lighting device according to (1), wherein when first reach time taken to change the luminance to the determined value is set in the first mode, the control section sets the first reach time set in the first mode for the determined period at the time of switching from the first mode to the second mode.

(3) The lighting device according to (1), wherein the control section: sets the light source to a first luminance in the first mode; and sets the light source to a second luminance lower than the first luminance in the second mode.

(4) The lighting device according to (3), wherein the control section: fixes the luminance of the light source in the first mode; and changes the luminance of the light source on the basis of an image scene in the second mode.

(5) The lighting device according to (1), wherein the control section sets plural reach times for the determined period by switching the plural reach times step by step.

(6) A lighting control method including: having a first mode and a second mode as luminance setting modes of a light source; and setting, in order to exercise variable control of a reach time taken to change luminance of the light source to a determined value, the reach time on the basis of the first mode for a determined period at the time of switching from the first mode to the second mode.

(7) A display device including: a light source; an image analysis section which performs, at the time of calculating an expansion coefficient from a first image including signal values for a first subpixel, a second subpixel, and a third subpixel and at the time of generating a luminance control signal for controlling luminance of the light source in order to exercise variable control of a reach time taken to change the luminance of the light source to a determined value, a determined process on the expansion coefficient and the luminance control signal and which outputs the expansion coefficient and the luminance control signal; an image signal generation section which generates a signal value for a fourth subpixel on the basis of the expansion coefficient after the determined process, which generates a second image including the signal values for the first subpixel, the second subpixel, the third subpixel, and the fourth subpixel, and which outputs the second image to a display side; and a light source control section which generates, on the basis of the luminance control signal after the determined process, a drive signal for making the light source emit light and which supplies the drive signal to the light source, wherein the image analysis section: has a first mode and a second mode as luminance setting modes of the light source; and sets, in order to exercise variable control of the reach time taken to change the luminance of the light source to the determined value, the reach time on the basis of the first mode for a determined period at the time of switching from the first mode to the second mode.

All examples and conditional language provided herein are intended for the pedagogical purposes of aiding the reader in understanding the invention and the concepts contributed by the inventor to further the art, and are not to be construed as limitations to such specifically recited examples and conditions, nor does the organization of such examples in the specification relate to a showing of the superiority and inferiority of the invention. Although one or more embodiments of the present invention have been described in detail, it should be understood that various changes, substitutions, and alterations could be made hereto without departing from the spirit and scope of the invention.

What is claimed is:

1. A display device comprising:

a light source;

an image analysis section which performs, at the time of calculating an expansion coefficient from a first image including signal values for a first subpixel, a second subpixel, and a third subpixel and at the time of generating a luminance control signal for controlling luminance of the light source in order to exercise variable control of a reach time taken to change the luminance of the light source to a determined value, a determined process on the expansion coefficient and the luminance control signal, and which outputs the expansion coefficient and the luminance control signal;

an image signal generation section which generates a signal value for a fourth subpixel on the basis of the expansion coefficient after the determined process, which generates a second image including the signal values for the first subpixel, the second subpixel, the third subpixel, and the fourth subpixel, and which outputs the second image to a display side; and a light source control section which generates, on the basis of the luminance control signal after the determined process, a drive signal for making the light source emit light and which supplies the drive signal to the light source, wherein the image analysis section:

has a first mode and a second mode as luminance setting modes of the light source; and sets, in order to exercise variable control of the reach time taken to change the luminance of the light source to the determined value, the reach time on the basis of the first mode for a determined period at the time of switching from the first mode to the second mode.

2. The display device according to claim 1, wherein when a first reach time taken to change the luminance to the determined value is set in the first mode, the image analysis section sets the first reach time set in the first mode for the determined period at the time of switching from the first mode to the second mode.

3. The display device according to claim 1, wherein the image analysis section:

sets the light source to a first luminance in the first mode; and sets the light source to a second luminance lower than the first luminance in the second mode.

4. The display device according to claim 3, wherein the image analysis section:

fixes the luminance of the light source in the first mode; and changes the luminance of the light source on the basis of an image scene in the second mode.

5. The display device according to claim 1, wherein the image analysis section sets plural reach times for the determined period by switching the plural reach times step-by-step.

6. A method of driving a display device comprising:

performing, by an image analysis section, at the time of calculating an expansion coefficient from a first image including signal values for a first subpixel, a second subpixel, and a third subpixel and at the time of generating a luminance control signal for controlling luminance of a light source in order to exercise variable control of a reach time taken to change the luminance of the light source to a determined value, a determined process on the expansion coefficient and the luminance control signal;

outputting, by the image analysis section, the expansion coefficient and the luminance control signal;

generating, by an image signal generation section, a signal value for a fourth subpixel on the basis of the expansion coefficient after the determined process, generating a second image including the signal values for the first subpixel, the second subpixel, the third subpixel, and the fourth subpixel, and outputting the second image to a display side; and generating, by a light source control section, on the basis of the luminance control signal after the determined process, a drive signal for making the light source emit light and supplying the drive signal to the light source, wherein the image analysis section:

has a first mode and a second mode as luminance setting modes of the light source; and sets, in order to exercise variable control of the reach time taken to change the luminance of the light source to the determined value, the reach time on the basis of the first mode for a determined period at the time of switching from the first mode to the second mode.

7. A display device comprising:

a light source;

image analysis circuitry configured to perform, at the time of calculating an expansion coefficient from a first image including signal values for a first subpixel, a second subpixel, and a third subpixel and at the time of generating a luminance control signal for controlling luminance of the light source in order to exercise variable control of a reach time taken to change the luminance of the light source to a determined value, a determined process on the expansion coefficient and the luminance control signal, and configured to output the expansion coefficient and the luminance control signal;

image signal generation circuitry configured to generate a signal value for a fourth subpixel on the basis of the expansion coefficient after the determined process, configured to generate a second image including the signal values for the first subpixel, the second subpixel, the third subpixel, and the fourth subpixel, and configured to output the second image to a display side; and light source control circuitry configured to generate, on the basis of the luminance control signal after the determined process, a drive signal for making the light source emit light and configured to supply the drive signal to the light source, wherein the image analysis circuitry is configured to have a first mode and a second mode as luminance setting modes of the light source; and is configured to set, in order to exercise variable control of the reach time taken to change the luminance of the light source to the determined value, the reach time on the basis of the first mode for a determined period at the time of switching from the first mode to the second mode.

8. The display device according to claim 7, wherein when a first reach time taken to change the luminance to the determined value is set in the first mode, the image analysis circuitry sets the first reach time set in the first mode for the determined period at the time of switching from the first mode to the second mode.

9. The display device according to claim 7, wherein the image analysis circuitry is configured to set the light source to a first luminance in the first mode, and set the light source to a second luminance lower than the first luminance in the second mode.

10. The display device according to claim 9, wherein the image analysis circuitry is configured to fix the luminance of the light source in the first mode, and change the luminance of the light source on the basis of an image scene in the second mode.

11. The display device according to claim 7, wherein the image analysis circuitry is configured to set plural reach times for the determined period by switching the plural reach times step-by-step.

* * * * *